United States Patent [19]

Dezelan

[11] 4,017,221

[45] Apr. 12, 1977

[54] COMBINED UNLOADING AND RELIEF VALVE FOR PUMP UNLOADING CIRCUIT

[75] Inventor: Joseph E. Dezelan, Indian Head Park, Ill.

[73] Assignee: Caterpillar Tractor Co., Peoria, Ill.

[22] Filed: Feb. 27, 1976

[21] Appl. No.: 661,881

[52] U.S. Cl. ..... 417/305; 137/495; 137/596.12; 60/494; 251/78; 417/440

[51] Int. Cl.[2] ..... F04B 49/02; F16K 31/14

[58] Field of Search ..... 417/440, 308, 305; 251/77, 78, 79, 80, 82, 83; 91/450; 60/494; 137/596.12, 495

[56] References Cited

UNITED STATES PATENTS

| | | | |
|---|---|---|---|
| 2,726,680 | 12/1955 | Baines | 137/596.12 X |
| 3,150,685 | 9/1964 | Lohbauer et al. | 137/596.13 |
| 3,183,977 | 5/1965 | Heckenkamp et al. | 137/596.12 X |
| 3,303,647 | 2/1967 | Futamata | 60/494 X |
| 3,522,999 | 8/1970 | Liles | 417/282 |
| 3,699,678 | 10/1972 | Swanson et al. | 180/66 R |
| 3,865,514 | 2/1975 | Lonnemo | 417/212 |

*Primary Examiner*—William L. Freeh
*Assistant Examiner*—Leonard Smith
*Attorney, Agent, or Firm*—Phillips, Moore, Weissenberger, Lempio & Majestic

[57] ABSTRACT

A hydraulic fluid circuit comprises an engine-driven pump for communicating pressurized fluid through a combined unloading and relief valve and to an implement control circuit of a construction vehicle. Actuating means are provided for selectively opening the valve during engine start-up to reduce fluid pressure in the valve and implement control circuit to a first predetermined level. An override means is operatively connected to the actuating means for preventing the valve from opening when the fluid pressure exceeds a second predetermined and operating level which is higher than the first predetermined level.

12 Claims, 1 Drawing Figure

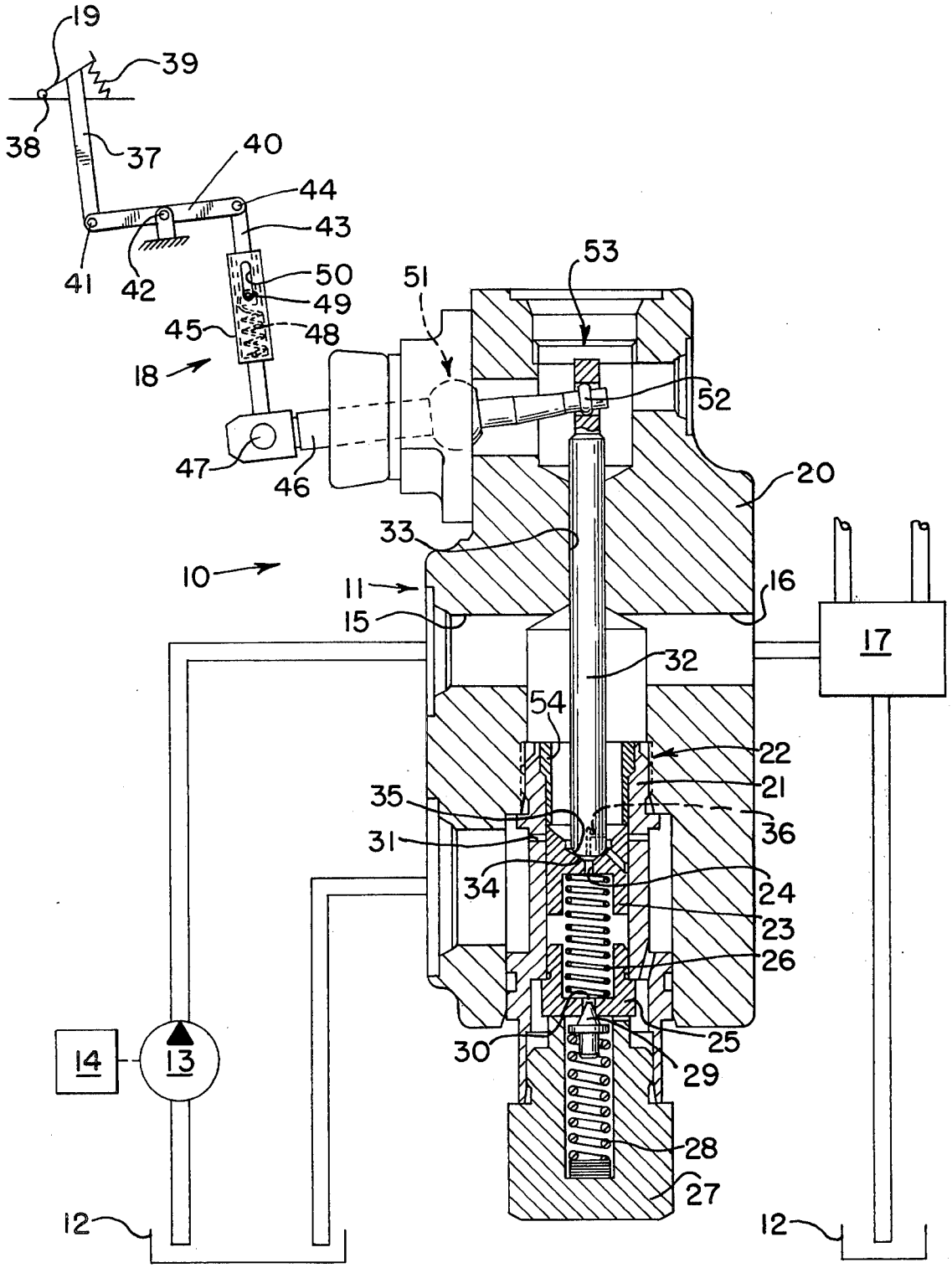
19
39
38
37
40
44
43
41
42
50
49
45
48
18
53
51
52
47
46
20
33
10
11
16
15
17
32
54
22
21
35
36
31
34
24
23
26
14
13
30
25
29
28
27
12
12

COMBINED UNLOADING AND RELIEF VALVE FOR PUMP UNLOADING CIRCUIT

BACKGROUND OF THE INVENTION

Construction vehicles, such as motor graders, comprise a hydraulic fluid circuit including an engine-driven pump adapted to communicate pressurized fluid to an implement control circuit. During engine start-up, for example, it is desirable to vent the pump pressure back to a reservoir to thereby reduce the torque loading imposed on the engine. An unloading system for this purpose is disclosed in U.S. Application Ser. No. 337,890, filed on Mar. 5, 1973 by J. E. Dezelan et al for "Pump Unloading Circuit", and assigned to the assignee of this application.

The latter system comprises a foot-actuated pedal whereby an operator can open an unloading valve during engine start-up. Occasionally, an operator in the field will employ the system as a "power pedal" whereby the blade of the motor grader, for example, is improperly used in a side-shifting manner to remove obstacles and the like. In essence, the operator unloads the pump and allows it to reach full speed upon revving-up of the engine to generate fluid pressure peaks up to 6,000 p.s.i., upon actuation of the "power pedal", to thus subject the integrated drive train and hydraulic fluid circuit to potential wear and damage.

SUMMARY OF THIS INVENTION

An object of this invention is to overcome the above, briefly described problems by providing an economical and noncomplex means for overriding a pump unloading fluid circuit to selectively prevent actuation thereof. The fluid circuit comprises a pressurized fluid source and an unloading valve means communicating with the source to receive pressurized fluid therefrom and for opening to reduce the pressure of the fluid to a first predetermined level. An override means is operatively connected to an operator-controlled actuating means, adapted to selectively open the valve means, for preventing such opening upon release of the actuating means by the operator and when the fluid pressure in the valve means exceeds a second predetermined and operating level which is higher than the first predetermined level. The override means thus provides a safety feature whereby the operator is rendered incapable of unloading the system once a start-up sequence has been accomplished to prevent loss of vital control functions, such as steering.

In the preferred embodiment of this invention, such override means comprises a lost-motion spring means mechanically connected in the actuating means which is pedal-controlled. In addition, the unloading valve means is preferably integrated into a pilot-operated relief valve for relieving system pressures when they exceed a third predetermined level higher than the abovementioned second operating level.

BRIEF DESCRIPTION OF THE DRAWING

Other objects of this invention will become apparent from the following description and accompanying drawing which illustrates a hydraulic fluid circuit with an unloading valve thereof shown in cross section.

DETAILED DESCRIPTION

The drawing illustrates a hydraulic fluid circuit 10 including a pump unloading circuit having an unloading valve means 11 adapted to receive pressurized fluid from a source, including a reservoir 12 and a pump 13. The pump may be driven by an engine, schematically illustrated at 14, to communicate the pressurized fluid to an inlet 15 of the unloading valve means. The hydraulic fluid circuit may be employed on a construction vehicle, such as a motor grader, whereby the pressurized fluid will normally discharge from an outlet 16 and be communicated to an implement control circuit 17, adapted to selectively communicate the fluid to the actuating cylinders for control of a motor grader blade, for example.

As will be hereinafter more fully described, unloading valve means 11 is adapted to selectively vent pump pressure communicated to inlet 15 thereof upon actuation of an actuating means 18, including an operator-controlled pedal 19. The unloading valve means comprises a housing 20 having a tubular member 21 detachably mounted therein at screw threads 22. A spool 23 is reciprocally mounted in a bore defined in member 21 and has an orifice 24 formed axially therethrough.

A cup-shaped member 25 is suitably secured within member 21 and a compression coil spring 26 is disposed between the member and spool 23. A cylindrical plug 27 is suitably secured in place on an outer end of member 21 and mounts a compression coil spring 28 therein which normally biases a poppet 29 against a conical seat 30 formed on an outer end of member 25. The poppet and seat thus comprises a normally closed pilot relief valve means mounted on member 21 and adapted to relief inordinately high system pressures back to reservoir 12, as will be hereinafter more fully described.

Spring 26 functions to normally bias spool 23 upwardly against an annular limit stop 54, secured within member 21, to cover a plurality of radially disposed ports or port means 31 formed through the sidewall of member 21 to communicate with reservoir 12. Actuating means 18 comprises an elongated rod 32 reciprocally mounted in a guide bore 33 formed in housing 20. The lower end 34 of the rod defines a semi-spherically shaped surface which abuts a conically shaped seat 35, defined on the upper end of spool 23. A branch passage 36 is formed in the lower end of the rod to continuously communicate fluid from inlet 15 and through port 24.

Actuating means 18 further comprises a link 37 having its upper end suitably attached to pedal 19 which is pivoted on the floor of a construction vehicle, for example, by a pin 38 and spring-biased by a compression coil spring 39 (to allow an increase in distance between points 44 and 47, as will be hereinafter described). The lower end of link 37 is pivotally connected to a first end of a bellcrank 40 at a pin 41 with the bellcrank being pivotally mounted on the vehicle by a pin 42. The second end of the bellcrank is pivotally connected to an upper end of a second link 43 by pivot pin 44 whereas the lower end of the second link has a tubular member 45 slidably mounted thereon.

The latter member comprises a third link which has its lower end pivotally connected to the first end of a second bellcrank or actuating lever 46 by a pin 47. A relatively "light" tension coil spring 48 is disposed in member 45 and has its upper end attached to a pin 49 secured to link 43. The pin is adapted to reciprocate in a lost motion slot 50 formed through a sidewall of member 45. The lower end of the spring is suitably anchored to member 45.

Bellcrank 46 is pivotally mounted intermediate its ends on housing 20 by a ball and socket connection or pivot means 51. The second end of the bellcrank has a roller 52 secured thereon which engages an upper end of rod 32. A plug stop 53 is secured in housing 20 to limit upward movement of the rod.

In operation, the start-up of engine 14 would normally drive pump 13 to impose a substantial torque load on the engine, in the absence of unloading valve means 11. However, the operator need merely depress pedal 19 to relieve fluid pressures downstream of pump 13, down to a first predetermined level to alleviate such load. In particular, upon depression of pedal 19, bellcrank 46 will pivot clockwise about pivot means 51 to move rod 32 downwardly. End 34 of the rod will engage and move spool 23 downwardly against spring 26 to vent pressurized fluid from inlet 15 to reservoir 12 via uncovered ports 31. Such venting will continue while the pedal is being depressed by the operator.

Upon release of the pedal by the operator and continued running of engine 14, implement control circuit 17 will be filled to increase system pressures above a higher second predetermined level which is communicated to lower end 34 of rod 32. The resultant force imposed on the lower end of the rod will thus raise it upwardly against plug stop 53 to permit spool 23 to be biased upwardly to its blocking position, shown in the drawing, to reclose ports 30. Thus, pump 13 will continue to supply the pressurized fluid requirements to implement control circuit 17 during operation of the vehicle.

Should the operator depress pedal 19 in an attempt to lower rod 32 to uncover ports 30, such effort will be of no avail due to the force of the pressurized fluid forcing rod 32 upwardly against plug stop 53 and the lost motion arrangement of the override means comprising spring 48. In particular, depression of the pedal will pivot bellcrank 40 counterclockwise about pivot pin 42 to expand relatively "light" spring 48 with no subsequent movement being transmitted to bellcrank 46. Thus, unloading of the system while the engine is running and with the pump pressure head established is prevented by the override means.

Should system pressures exceed a third predetermined level which is substantially above the second, operating level, poppet 29 of the pilot operated relief valve means will open to relieve pressure to reservoir 12. Such relief, will, in turn, create a pressure differential on either side of spool 23 to permit the spool to move downwardly against the force of spring 26 to uncover ports 31. Thus, ports 31 will relieve excess system pressures to their normal operating levels and will reclose the ports automatically subsequent to such relief.

What is claimed is:

1. A hydraulic fluid circuit comprising a pressurized fluid source including a pump and a reservoir, unloading valve means having an inlet communicating with said source for receiving pressurized fluid therefrom and for opening to reduce the pressure of said fluid below a first predetermined level, actuating means for selectively opening said unloading valve means, and override means operatively connected to said actuating means for preventing said actuating means from opening said unloading valve means when the fluid pressure therein exceeds a second predetermined level which is higher than said first predetermined level.

2. The fluid circuit of claim 1 further comprising an implement control circuit communicating with an outlet of said unloading valve means.

3. The fluid circuit of claim 1 wherein said override means comprises a tension coil spring.

4. The fluid circuit of claim 3 wherein said actuating means comprises a pair of links and wherein opposite ends of said spring are each attached to a respective link.

5. The fluid circuit of claim 1 wherein said unloading valve means comprises a housing having a spool reciprocally mounted therein for movement between a closed position normally covering port means defined in said unloading valve means and an open position uncovering said port means for communicating said inlet with said reservoir via said port means.

6. The fluid circuit of claim 5 further comprising an annular limit stop secured within said tubular member for engaging an end of said spool when said spool is in its closed position.

7. The fluid circuit of claim 5 wherein said port means comprises a plurality of ports formed through a sidewall of a tubular member releasably attached to said housing, said spool reciprocally mounted in said tubular member.

8. The fluid circuit of claim 5 wherein said actuating means comprises a rod reciprocally mounted in said housing and having an end thereof normally engaged with said spool.

9. The fluid circuit of claim 8 further comprising spring means normally biasing said spool into engagement with the end of said rod.

10. The fluid circuit of claim 5 further comprising normally closed relief valve means mounted on said housing for opening to communicate fluid to said reservoir when the pressure of said fluid exceeds a third predetermined level higher than said second predetermined level.

11. The fluid circuit of claim 10 wherein said relief valve means is pilot-operated and comprises said spool.

12. The fluid circuit of claim 11 wherein said relief valve means further comprises a spring-biased poppet valve and means communicating said inlet with said poppet valve.

* * * * *